US005906379A

United States Patent [19]

Kelle et al.

[11] Patent Number: 5,906,379

[45] Date of Patent: May 25, 1999

[54] MOVABLE EQUIPMENT, ESPECIALLY FOR MEDICAL EXERCISE AND TREATMENT PURPOSES

[75] Inventors: Antal Kelle, Törökbálint; Krisztina Majercsik, Budapest, both of Hungary

[73] Assignee: sports Unlimited Sportartikel-Vertrieb und Beratung GmbH, Lehrberg, Germany

[21] Appl. No.: 08/783,728

[22] Filed: Jan. 16, 1997

[30] Foreign Application Priority Data

Jan. 26, 1996 [HU] Hungary ..... 9600170
Nov. 9, 1996 [DE] Germany ..... 196 46 366

[51] Int. Cl.[6] ..... A63G 19/00

[52] U.S. Cl. ..... 280/1.204

[58] Field of Search ..... 280/1.13, 1.181, 280/1.182, 1.191, 1.201, 1.204; 180/8.1, 8.6

[56] References Cited

U.S. PATENT DOCUMENTS

D. 164,097 7/1951 Campbell ..... 280/1.204
1,369,628 2/1921 Dahl ..... 280/1.204
2,791,434 5/1957 Wheeler ..... 280/1.204
2,965,385 12/1960 Ayala ..... 280/1.204
2,996,304 8/1961 Lange ..... 280/1.204
4,816,002 3/1989 Brodrib ..... 280/1.181

*Primary Examiner*—Kevin Hurley
*Attorney, Agent, or Firm*—Jordan and Hamburg LLP

[57] ABSTRACT

A mobile apparatus, especially one for medical exercise and treatment purposes, with a seat for accommodating a person, below which several foot elements, which can be set down on the floor, are movably mounted in each case in a bearing mounting on the seat side of the apparatus, which bearing mounting has at least one first bearing element, which protrudes into the bearing recess and which detachably abuts at least one second bearing element formed at the foot element, so that the foot element, which can be moved essentially vertically and, with that, its floor touch-down surface, in a position, disengaged from the floor, can be swiveled forward in the direction of motion of the toy with engagement of the two bearing elements, the foot element, when the floor touch-down surface touches down on the floor, being movable essentially vertically upwards with disengagement and, at the same time, being guided in the bearing mounting in such a manner that a component of motion in the running direction is imparted by the vertical motion during the touching-down process.

29 Claims, 2 Drawing Sheets

MOVABLE EQUIPMENT, ESPECIALLY FOR MEDICAL EXERCISE AND TREATMENT PURPOSES

BACKGROUND OF THE INVENTION

The invention relates to movable equipment, especially for medical exercise and treatment purposes.

Equilibrium disorders and development deficiencies in this respect, which occur frequently particularly in children, represent appreciable problems for the persons affected. These problems can be counteracted by equilibrium exercises using motor-operated movement courses, so that it is possible to promote the sense of equilibrium. The previously known exercise possibilities and apparatuses, however, permit only limited exercise. There is therefore a need for a suitable apparatus, with which psychomotor training, beneficial from medical points of view is possible for persons afflicted with equilibrium disorders.

Aside from these urgent medical problems, the invention attempts to find a remedy also in a different field, namely that of mobile toys, also those in the form of an animal. Such toys are known in various forms. In order to create an incentive for children to play, which is the basis for occupying themselves with the toy, it is necessary to configure the purpose and value of the play as interestingly as possible. Especially for toys in the form of animals, this can be attained particularly by attempting to imitate in as lifelike a fashion as possible the motion of the imitated, stylized animal, as far as this is possible within the scope of the mechanics, which can be used. At the same time, in order to increase the purpose of the play, the lifelike movement should be initiated with the cooperation of the child, who is seated on the toy. This objective, however, is not attained or is attained only inadequately with known toys. As a rule, such toys are constructed so that, although they have a seat for accommodating the child, they are in contact with the floor through rollers or the like, by means of which motion can be brought about by the child, when the feet of the child are braced against the floor. Such a toy is described, for example, in the German publication 295 15 785 U1. However, motion, which comes even only close to that of the stylized animal, is not achieved with such a toy.

These two initial problems become connected when it is a question of the medical treatment of children. After all, it is well known that children, who are to be treated, prefer to occupy themselves with medical exercise equipment, etc., if they receive a playful incentive for doing so.

It is therefore an object of the invention to provide an apparatus, which can be used particularly for psychomotor exercise.

SUMMARY OF THE INVENTION

This objective is accomplished by a mobile apparatus, especially one for medical exercise and treatment purposes, with a seat for accommodating a person, below which several foot elements, which can be set down on the floor, are movably mounted in each case in a bearing mounting on the seat side of the apparatus, which bearing mounting has at least one first bearing element, which protrudes into the bearing recess and which detachably abuts at least one second bearing element formed at the foot element, so that the foot element, which can be moved essentially vertically and, with that, its floor touch-down surface, in a position, disengaged from the floor, can be swiveled forward in the direction of motion of the toy with engagement of the two bearing elements, the foot element, when the floor touch-down surface touches down on the floor, being movable essentially vertically upwards with disengagement and, at the same time, being guided in the bearing mounting in such a manner that a component of motion in the running direction (A) is imparted by the vertical motion during the touching-down process.

The inventive apparatus is distinguished by a special form of arrangement and mounting of the foot elements. Depending on the number of foot elements provided, the latter can be moved in each case between a first and a second position. In a first, no-load position, in which the foot element is disengaged from the floor and, for example, when four such feet are provided, the apparatus is supported only on the two foot elements on one side, the foot elements, which are not under a load in this position, being swiveled forward. If now the apparatus is quasi tilted by a change in weight, which can be brought about only by the person accommodated on the seat, and the foot elements, which previously were freely suspended and swiveled forwards, are set down on the floor, these foot elements, due to the special nature of the support in the bearing mounting, are quasi swiveled forwards about the touching-down point of the floor touching-down surface, by means of which a movement component in the running direction is imparted to the person seated or standing thereon, that is, the seat is, as it were, guided forwards by the vertical motion of the foot in the bearing mounting. At the same time, the foot elements on the other side of the apparatus, which is equipped, by way of example, with four foot elements, are detached from the floor and hang free. As a result, these foot elements are now also swiveled forward and a new movement cycle becomes possible by a further weight shift to the other side. An apparatus is thus created, which requires a different form of movement, which equally requires a contribution by the person, namely a shift in weight.

With that, a very important therapeutic purpose can be achieved. The inventive toy can be used particularly advantageously for psychomotor exercises, in order to eliminate any deficiencies, which may exist, because a shift in weight is always required in order to move the apparatus forwards. For therapeutic purposes, the person can advantageously be positioned on the seat, for example, in a standing, kneeling or seated position, in order then to achieve a forwards motion of the apparatus by appropriate movements. Children especially accept the need to carry out the movements required more readily, if the apparatus is constructed in the form of a stylized animal and optionally provided with appropriate accessories, since the desire to play is then aroused and a play character is conferred on the whole course of the movement. Due to the nature of the movement, especially the balancing behavior, which is important from a medical point of view, is practiced and promoted, so that meaningful psychomotor exercises can be carried out. In addition, a use in the handicapped area and for rehabilitation measures is also possible.

If the apparatus is constructed in the shape of an animal and used strictly as a toy, motion, which comes close to that of the animal actually being imitated, is possible. For example, when four foot elements are provided in each case in the form of two side pairs, a turtle-like crawling or wobbling motion is possible. Likewise, when two or three foot elements, for example, are disposed one behind the other, a caterpillar-like motion is possible, since tilting of the "toy" is always required in order to bring the foot elements partially into or out of the position, in which they touch down on the floor, and to realize forwards motion. From this results an imitation of the natural motion, which can be realized in this manner essentially more like the example than it can with the previously known games.

As already described, two or four foot elements may be provided, so that a tilting motion of the toy from left to right is possible. In order to increase the instability of the apparatus and, with that, the demands on the person with respect to movement coordination, provisions can furthermore be made within the scope of the invention so that the foot elements are mounted so that they can be tilted in a direction essentially perpendicular to the direction of motion of the apparatus, as a result of which a different type of equilibrium shift is required. So that the foot elements, which are not carrying a load, can be detached from the floor by appropriately tilting the apparatus when the foot elements are disposed next to one another essentially perpendicularly to the running direction, provisions can be made in a further development of the invention so that the bearing mountings are disposed at such an angle to one another that, if the foot elements are disposed next to one another essentially perpendicularly to the running direction and the foot element or foot elements of the one side are touched down under load, the foot element or foot elements of the other side assume the position detached from the floor. Due to the angular arrangement of the bearing mountings at the seat, it is ensured particularly advantageously that, when the apparatus seat is tilted to one side, the foot elements of the other side a re raised automatically, so that t he s e can swing into the forwards directed position as a result of the engagement of the two bearing elements. By appropriately shifting the weight to the other side, the foot elements, which were free until then, can now be placed under load, so that advantageously the opposite foot elements can assume the position, in which they are swung forwards. By changing the angle between the bearing mountings, the size or shape of the foot elements can be varied since, depending on the angular position and, with that, the position of the bearing mounting carrying the free foot element, the clearance above the floor of the respective freely suspended foot elements changes when the other bearing mounting is placed under load.

Alternatively to the angular arrangement of the foot elements, provisions may also be made pursuant to the invention that the foot elements can be swiveled about an essentially horizontal axis, it being possible to swivel the foot elements about an essentially horizontal axis and the bearing mountings being constructed in such a manner and disposed at the seat that, when at least one foot element is touched down under load, at least one other foot element assumes the position, in which it is not in contact with the floor. Aside from a parallel arrangement of two or more foot elements, it is also possible with the inventive apparatus to connect two or more foot elements one behind the other, in order to make tilting of the apparatus from the front to the rear possible or necessary for a forward movement. Consequently, a completely different course of motions is required here. In this connection, however, it is necessary to provide a horizontal axis as pivoting axis.

In a further development of the invention, provisions can be made that the floor setting-down surfaces are constructed essentially flat and, in the position in which they are not in contact with the floor, are at an angle to the floor. The flat-surface construction makes possible, on the one hand, a relatively secure upright position especially when only two foot elements are disposed one behind the other or next to one another, the upright position occurring in each case on a foot element under load. By appropriately adjusting the angle of the floor touch-down surface to the floor or to the axis through the center of gravity of the foot element, the path, which can be covered by setting down the foot element or by the respective course of movement, can be determined advantageously.

In order to indicate as simply as possible a shape for the bearing elements, which is simple and effective from manufacturing and functional points of view, provisions can furthermore be made on the basis of the invention so that the first and/or the second bearing element is constructed as a projection protruding into the recess. The bearing element itself on the side of the foot, optionally the projection, preferably is oblong, constructed essentially linearly and extends at least over half the width of the foot element, so that it is ensured that a secure engagement is always possible. In a further development of the invention, provisions can be made so that several, preferably three, first bearing elements, optionally projections, on the bearing side are assigned to the bearing element, optionally the projection on the foot side.

Since provisions can furthermore be made within the scope of the invention that the foot elements and the seat can be detachably connected with one another, which is of advantage from the manufacturing, handling and shipping points of view, provisions are furthermore made on the basis of the invention that the first bearing element, optionally the projection, on the bearing side is constructed as an elastic hook or the like. This can, of course, also be the case when several first bearing elements are provided. With the construction as elastic hooks which, in the final analysis, prevents detachment of the foot element from the bearing mounting, since it limits the movement of the foot element when the latter hangs down freely it is possible particularly advantageously to bring the foot element into and out of engagement with the bearing recess by a short spring-back of the hook. At the same time, it has proven to be advantageous, particularly from a manufacturing point of view, if the elastic hook is disposed pursuant to the invention directly at the underside of the seat and forms a wall or side constituting the boundary of the bearing mounting, because the seat and also the foot elements can be constructed as one-piece elements, especially from plastic, particularly by injection molding. Wood or metal constructions are also conceivable.

As already described, it is possible on the basis of the invention to dispose at least two foot elements behind one another in the running direction or next to one another perpendicularly to the running direction. If two or more foot elements are disposed behind one another in the running direction, so that a tilting motion from the front to the rear and the reverse are required to initiate forwards movement, a sufficiently stable upright position can be attained particularly if the floor touching-down surface of the foot elements is constructed flat and with a plane surface. If two foot elements are disposed next to one another perpendicularly to the running direction, movement admittedly is possible, especially when foot elements with a plane surface are used. However, to increase the stability, provisions can be made in this case so that at least one stabilizer element, which is in constant contact with the floor, is provided. This can be realized, for example, by a roll or the like, which is set down on the floor.

As already mentioned, provisions can be made pursuant to the invention that four foot elements can be provided in pairs next to one another, so that, when an animal is imitated, the apparatus can assume, for example, the shape of a turtle. In order to realize a curvilinear motion in addition to a linear motion, provisions can furthermore be made on the basis of the invention so that, in the case of foot elements, which are disposed in pairs next to one another, the toot element or elements of one side are mounted so that they can be swiveled through a larger angle forwards in the direction of motion, than can the foot element or elements on the other side.

Further advantages, distinguishing features and details of the invention arise out of the example described in the following and from the accompanying drawings.

DESCRIPTION OF THE PREFERRED EMBODIMENTS

Figure 1:
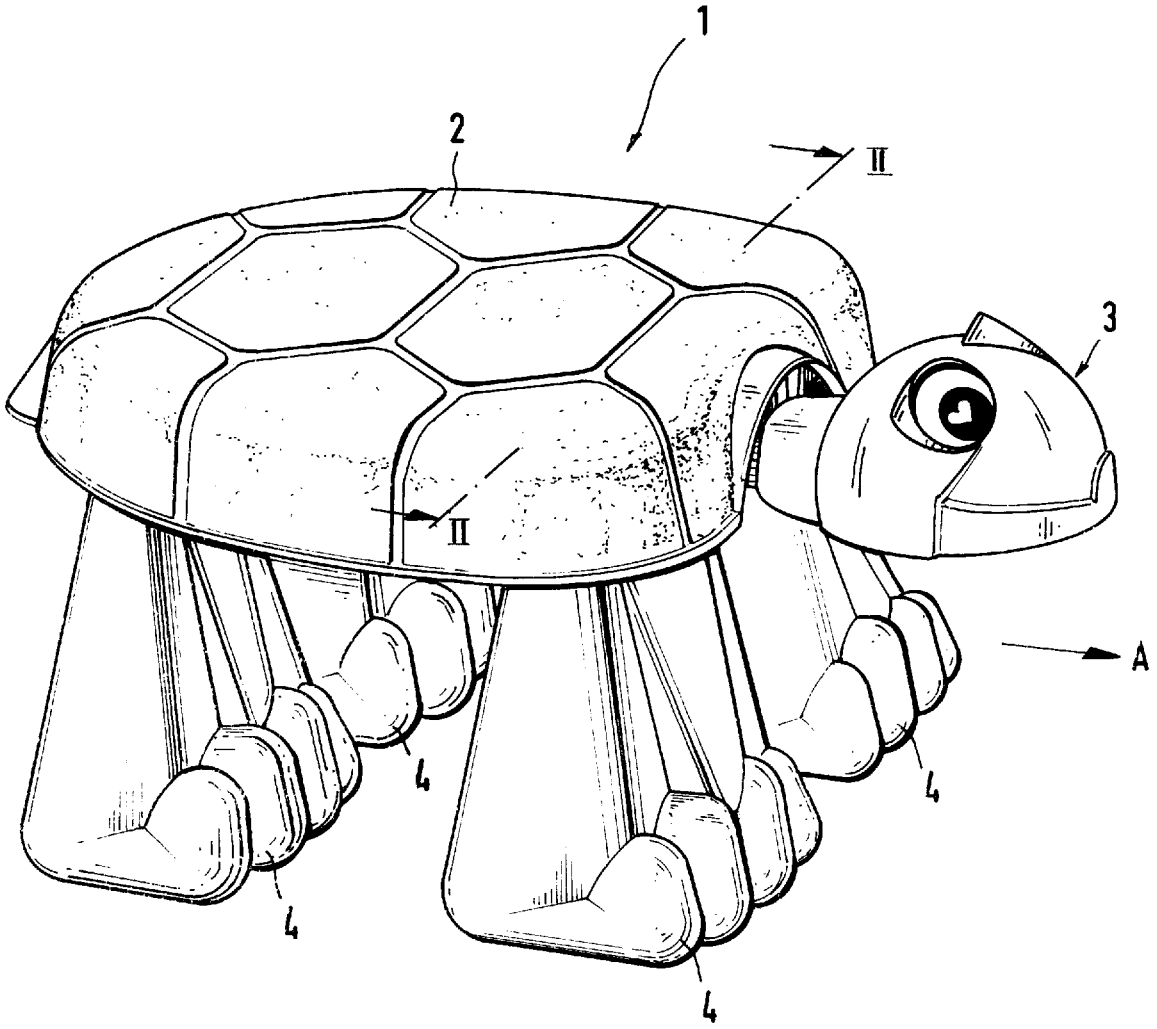
FIG. 1 shows the inventive apparatus in the form of a turtle in perspective view.

FIG. 1 shows an apparatus 1, which can be produced, for example, from plastic and consists of a seat 2, which is constructed to accommodate, for example, a child in the sitting, standing, kneeling, etc. position. Below the seat 2, first of all a head element 3 is disposed, which, as also the seat 2, is constructed appropriately to stylize a turtle. Furthermore, four foot elements 4 are provided, the mounting of which will be described in greater detail in connection with FIGS. 2 to 4. The apparatus 1 can be moved forward in the direction of arrow A. For this purpose the seat 2 can be tilted by an appropriate shift in the weight of the child thereon about the axis define by arrow A, as will be described now.

Figure 2:
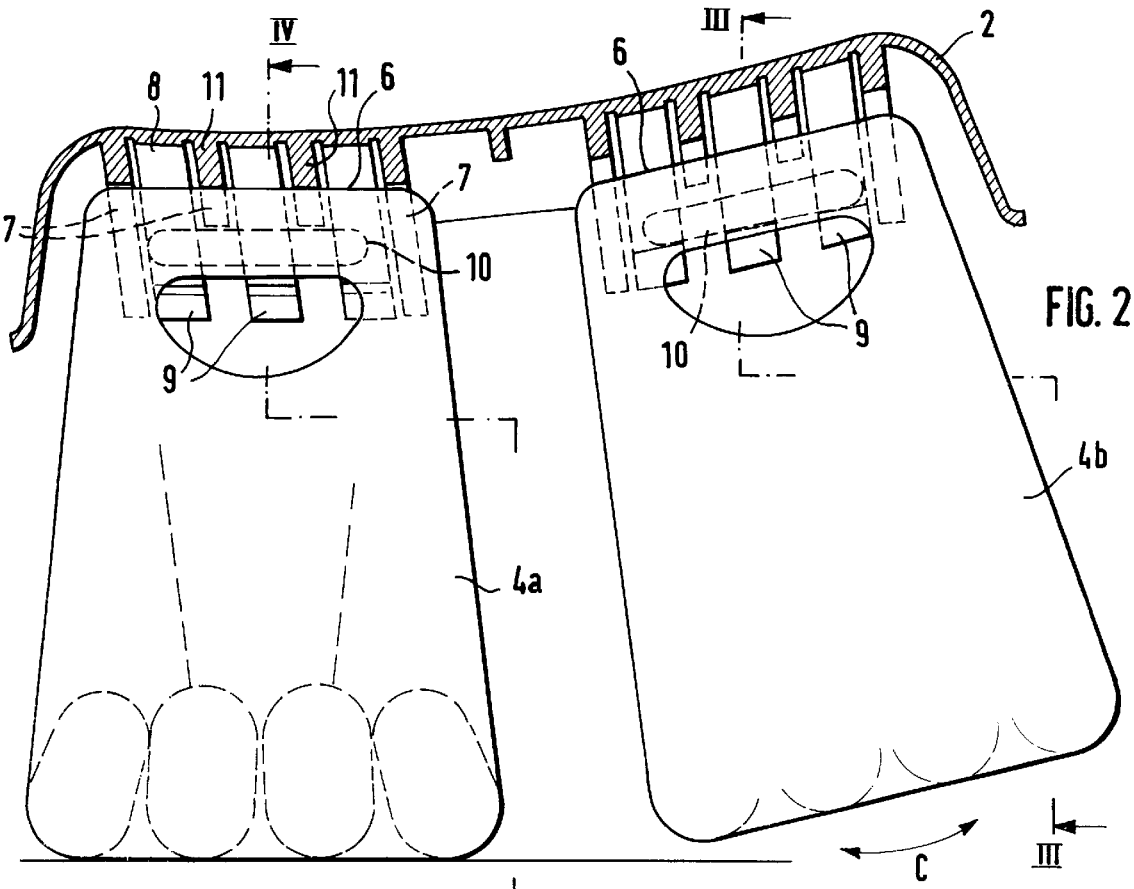
FIG. 2 shows a view along the line II—II of FIG. 1, partially in section, of a pair of foot elements in a unilaterally loaded position.
Figure 4:
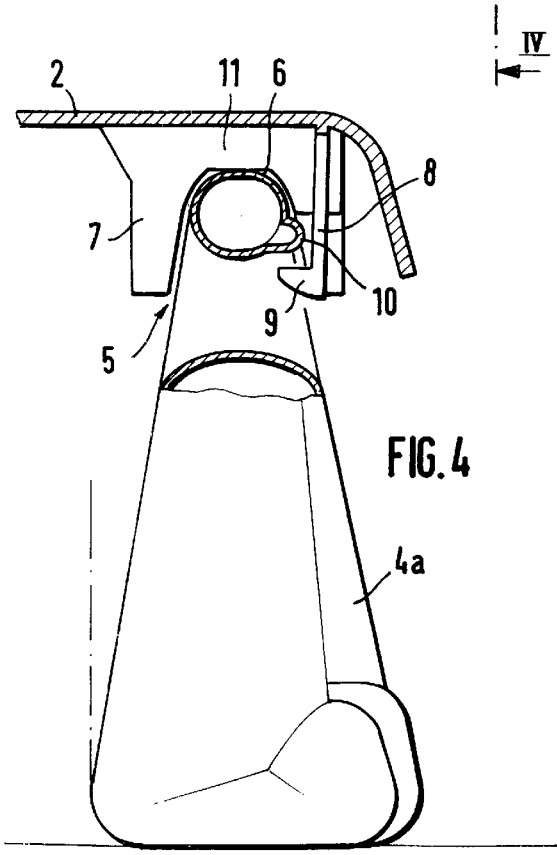
FIG. 4 shows a view, partially in section, of the foot element, when under load, along the line IV—IV of FIG. 2.
Figure 3:
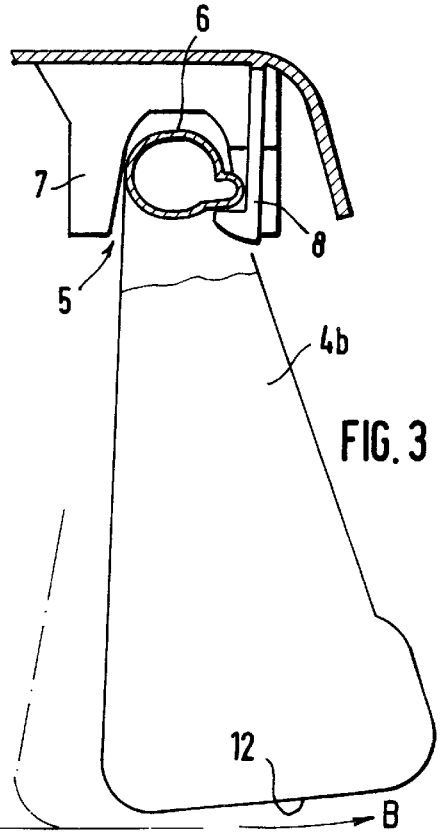
FIG. 3 shows a view, partially in section, of the foot element of FIG. 2, when not under a load, along the line III—III of FIG. 2.

The inventive arrangement of the foot elements at the seat, which makes the forward motion possible, is shown in FIGS. 2 to 4. FIG. 2 shows the seat 2 in section. Below the seat 2, bearing mountings 5 are constructed, in which the upper ends 6 of the foot elements 4 run are supported. The bearing mountings 5 comprise side arms 7, opposite to which side arms 8, which form the boundary of the bearing mountings 5, are assigned. As shown by FIG. 2, four side arms 7 in all are provided, which protrude from the underside of the seat 2. Between in each case two side arms 7, a side arm 8 is provided on the opposite side of the bearing mounting. Each side arm 8 is provided at its lower end with a bearing element 9 in the form of a hook, which protrudes into the bearing mounting 5. As shown particularly in FIGS. 3 and 4, the foot element 4 in the bearing mounting 5 is disposed so that it can be moved essentially vertically and, at the same time, swiveled. This enables it to assume the different positions shown in FIG. 2. As shown in FIG. 2, the left foot element 4*a* is placed on the floor. Concretely, this means that a child on the seat 2 has shifted its weight to this side. In this case, which corresponds to the condition shown in FIG. 4, the foot element 4*a* is pressed upward into the bearing mounting. A bearing element 10 in the form of the projection shown, formed at the foot element 4*a*, does not engage the bearing element 9 assigned to it. In this position, the upper side of the foot element 4*a* lies against the limiting projections 11 on the seat side, as shown in FIG. 2.

The second possible end position of a foot element is shown in FIG. 2 with respect to foot element 4*b*. As a result of the tilting of the seat 2, this foot element 4*b* is not under a load and can assume its lower position within the bearing mounting 5, as shown in FIG. 3. In this case, the foot element sinks and slides down into the bearing mounting 5, this motion being limited by the bearing element 9, which engages the bearing element 10 of the foot element 4*b* in a certain position. This means that further vertical motion downward is no longer possible. At the same time, this supporting of the foot element 4*b* at the front side brings about a swiveling of the foot element 4*b* towards the front in the direction of motion, as indicated in FIG. 3 by arrow B. This forwards motion is limited when the upper region 6 of the foot element 4*b* comes up against the rear side arms 7 of the bearing mounting 5 and thus cannot be swiveled further in the forward direction. This bearing position is also shown in the view of FIG. 2. As indicated by the double arrow C, the foot element is accommodated, when not under load, so that it can also swivel or tilt sideways. This is useful for the tilting movement, which is described in the following and serves for the forward motion. As can be seen from FIG. 2, the arrangement of the bearing mountings and, with that, of the foot elements at an angle to one another also contributes to this, because it ensures that the foot elements, when not under load, are detached from the floor and can swing forwards.

The actual forwards motion, which is brought about by the shift in weight of the child on seat 2 and, with that, by the continuous change in the position of the foot elements between the end positions shown in FIGS. 3 and 4, comes about as follows:

Starting out from the position shown in FIG. 2, in which the foot element 4*a* rests on the floor, the foot element 4*b* is in the position shown in FIG. 3, in which is can move freely. If now the child shifts its weight to the side of foot element 4*b*, the latter is set down with its floor touch-down surface 12 on the floor and fixed there. As the weight is shifted further, the foot element in the bearing mounting is guided essentially vertically upward and the bearing mounting is pressed downward with respect to the now stationary foot element. However, upper region 6 of the foot element 4*b* is guided in such a manner in the bearing mounting 5 and bearing arms 7, that the foot element is pressed forward by this motion, that is, it is swiveled forward, as it were, about the lower floor touching-down point. At the same time, the upper region 6 of the foot element and, with that, the seat, carrying the child, is swiveled forward in the direction of motion about the floor touching-down point, as indicated by the line of dots and dashes in FIG. 4, which reproduces the state before there is touching-down on the floor, that is, the state shown in FIG. 3.

If now the weight on the foot element 4*a*, which is in the position shown in FIG. 3 (with respect to the foot element 4*b* there) is shifted once again, the process just described takes place with respect to this foot element. In this case, the foot element 4*b* is disengaged from the touching-down position shown in FIG. 4 and slides downwards within the bearing mounting 5, until the bearing elements 9, 10 are engaged and the swiveling motion (arrow B) in the forwards direction is limited by the rear side arms 7 of the bearing mounting 5, so that the foot element 4*b* once again assumes the position shown in FIG. 3.

By alternating the shift in weight and, with that, by alternating the position of the foot elements between that shown in FIG. 3 and that shown in FIG. 4, a forwards movement, which corresponds essentially to the waddling of a stylized turtle, is possible.

What we claim is:

1. A mobile apparatus for use by a person comprising a seat for accommodating said person, said seat having opposed sides, a plurality of foot elements underlying said seat, bearing means rotatably and slidably mounting said foot elements on said seat, said bearing means enabling each of said foot elements to move between a floor-engaging position upon the application of a generally downwardly directed load to one of said sides of said seat and a floor-disengaged position upon shifting of said load from said one side of said seat to the other side of said seat, each of said foot elements upon moving from said floor-engaging position to said floor-disengaged position providing for vertical downward movement of the foot element relative to the seat and rotative movement of the foot element in a rearward direction relative to the seat, each of said foot elements upon moving from said floor-disengaged positions to said floor-engaged position providing for vertical downward movement of the seat relative to the foot element and rotative movement of the foot element in a forward direction relative to the seat such that said seat is thereby advanced in a forward direction over the floor during said rotative movement of said foot element in said forward direction.

2. A mobile apparatus according to claim 1 wherein said mobile apparatus has a central axis parallel to said forward direction, at least one of said foot elements being disposed on one side of said central axis and at least one other foot element being disposed on the opposite side of said central axis, said one foot element being in its floor-engaging position when said other foot element is in its floor-disengaged position, said other foot element being in its floor engaging position when said one foot element is in its floor-disengaged position.

3. A mobile apparatus according to claim 1 wherein said bearing means supports said foot elements for rotative movement about an axis substantially perpendicular to said forward direction.

4. A mobile apparatus according to claim 1 wherein said mobile apparatus has a central axis parallel to said forward direction, said opposed sides of said seat being on opposite sides of said central axis, at least one of said foot elements being disposed on one side of said central axis and at least one other foot element being disposed on the other side of said central axis, the axes of the bearing means for said one and said other foot elements being substantially horizontally disposed in such a manner that when the load is applied to said one side of the seat on said one side of the central axis, said one foot element is moved to said floor-engaging position and said other foot element moves to said floor-disengaged position.

5. A mobile apparatus according to claim 1 wherein said mobile apparatus has a central axis parallel to said forward direction, said foot elements being provided in pairs with one foot element of each pair being disposed on one side of said central axis and the other foot element of each pair being disposed on the other side of said central axis.

6. A mobile apparatus according to claim 1 wherein at least two of said foot elements are provided with one of said two foot elements being disposed forwardly of the other of said two foot elements considered in said forward direction.

7. A mobile apparatus according to claim 1 wherein each of said foot elements have a floor engaging, generally planar surface which is generally parallel to the floor when said foot element is in its floor-engaging position and which is disposed at an acute angle relative to said floor when said foot element is in its floor-disengaged position.

8. A mobile apparatus according to claim 1 wherein said mobile apparatus has a central axis parallel to said forward direction, a first and second of said foot elements being disposed on one side of said central axis one behind the other considered in said forward direction, a third and a fourth of said foot elements being disposed on the opposite side of said central axis one behind the other considered in said forward direction, said first and third foot elements being rotatable about first and third axes respectively with each of said first and third axes being generally perpendicular to said central axis, said second and fourth foot elements being rotatable about second and fourth axes respectively with each of said second and fourth axes being generally perpendicular to said central axis.

9. A mobile apparatus according to claim 1 wherein said bearing means comprises a bearing mounting on said seat, said bearing mounting including a bearing recess having an upper part and a lower part, said foot element having an upper end portion received in said recess, said upper end portion of said foot element being disposed in said upper part of said bearing recess when said foot element is in said floor-engaging position, said upper end portion of said foot element being disposed in said lower part of said bearing recess when said foot element is in said floor-disengaged position.

10. A mobile apparatus according to claim 9 wherein said bearing mounting on said seat includes a protrusion extending into said recess.

11. A mobile apparatus according to claim 1 wherein each foot element comprises a one-piece of integral material.

12. A mobile apparatus according to claim 11 wherein said material is a plastic material.

13. A mobile apparatus according to claim 1 wherein the mobile apparatus is a medical device.

14. A mobile apparatus according to claim 1 wherein the mobile apparatus is a toy.

15. A mobile apparatus according to claim 1 wherein the mobile apparatus is constructed to resemble an animal.

16. A mobile apparatus for use by a person comprising a seat for accommodating said person, a plurality of foot elements underlying said seat, bearing means rotatably and slidably mounting said foot elements on said seat, said bearing means enabling each of said foot elements to move between a floor-engaging position and a floor-disengaged position, each of said foot elements upon moving from said floor-engaging position to said floor-disengaged position providing for vertical downward movement of the foot element relative to the seat and rotative movement of the foot element in a rearward direction relative to the seat, each of said foot elements upon moving from said floor-disengaged positions to said floor-engaged position providing for vertical downward movement of the seat relative to the foot element and rotative movement of the foot element in a forward direction relative to the seat such that said seat is thereby advanced in a forward direction over the floor during said rotative movement of said foot element in said forward direction, said bearing means comprising a bearing mounting on said seat, said bearing mounting including a bearing recess having an upper part and a lower part, said foot element having an upper end portion received in said recess, said upper end portion of said foot element being disposed in said upper part of said bearing recess when said foot element is in said floor-engaging position, said upper end portion of said foot element being disposed in said lower part of said bearing recess when said foot element is in said floor-disengaged position, said bearing mounting on said seat including a protrusion extending into said recess, said upper end portion of said foot element including a central part and a projection projecting from said central part, said protrusion on said bearing mounting underlying said projection on said central part of said upper portion of said foot element.

17. A mobile apparatus according to claim 16 wherein said central part has a generally circular cross sectional configuration.

18. A mobile apparatus according to claim 16 wherein said projection on said central part extends linearly to over one-half the width of the foot element.

19. A mobile apparatus according to claim 16 wherein said projection on said central part has an arcuate cross sectional configuration.

20. A mobile apparatus for use by a person comprising a seat for accommodating said person, a plurality of foot elements underlying said seat, bearing means rotatably and slidably mounting said foot elements on said seat, said bearing means enabling each of said foot elements to move between a floor-engaging position and a floor-disengaged position, each of said foot elements upon moving from said floor-engaging position to said floor-disengaged position providing for vertical downward movement of the foot element relative to the seat and rotative movement of the foot element in a rearward direction relative to the seat, each of said foot elements upon moving from said floor-disengaged positions to said floor-engaged position providing for vertical downward movement of the seat relative to the foot element and rotative movement of the foot element in a forward direction relative to the seat such that said seat is thereby advanced in a forward direction over the floor during said rotative movement of said foot element in said forward direction, said bearing means including a bearing mounting, said seat and said bearing mounting comprising a one piece of integral material.

21. A mobile apparatus according to claim 20 wherein said material is a plastic material.

22. A mobile apparatus for use by a person comprising a seat for accommodating said person, a plurality of foot elements underlying said seat, bearing means rotatably and slidably mounting said foot elements on said seat, said bearing means enabling each of said foot elements to move between a floor-engaging position and a floor-disengaged position, each of said foot elements upon moving from said floor-engaging position to said floor-disengaged position providing for vertical downward movement of the foot element relative to the seat and rotative movement of the foot element in a rearward direction relative to the seat, each of said foot elements upon moving from said floor-disengaged positions to said floor-engaged position providing for vertical downward movement of the seat relative to the foot element and rotative movement of the foot element in a forward direction relative to the seat such that said seat is thereby advanced in a forward direction over the floor during said rotative movement of said foot element in said forward direction, the mobile apparatus having a central axis parallel to said forward direction, at least one of said foot elements being disposed on one side of said central axis and at least one other foot element being disposed on the other side of said central axis, the axis of the bearing means for said one foot element being disposed at an obtuse angle relative to the axis of the bearing means for said other foot element, such that when a load is applied to the seat on said one side of the central axis, said one foot element is moved to said floor-engaging position and said other foot element moves to said floor-disengaged position.

23. A mobile apparatus for use by a person comprising a seat for accommodating said person, a plurality of foot elements underlying said seat, bearing means rotatably and slidably mounting said foot elements on said seat, said bearing means enabling each of said foot elements to move between a floor-engaging position and a floor-disengaged position, each of said foot elements upon moving from said floor-engaging position to said floor-disengaged position providing for vertical downward movement of the foot element relative to the seat and rotative movement of the foot element in a rearward direction relative to the seat, each of said foot elements upon moving from said floor-disengaged positions to said floor-engaged position providing for vertical downward movement of the seat relative to the foot element and rotative movement of the foot element in a forward direction relative to the seat such that said seat is thereby advanced in a forward direction over the floor during said rotative movement of said foot element in said forward direction, the mobile apparatus having a central axis parallel to said forward direction, at least one pair of said foot elements being provided on said seat with one foot element of said pair being disposed on one side of said central axis and the other foot element of said pair being disposed on the other side of said central axis, said bearing means for said one foot element being rotated in a forward direction a first amount when said one foot element is moved from its floor-disengaged position to its floor-engaging position, said bearing means for said other foot element being rotated in its forward direction a second amount when said other foot element is moved from its floor-disengaged position to its floor engaging position, said first amount being greater than said second amount.

24. A mobile apparatus for use by a person comprising a seat for accommodating said person, a plurality of foot elements underlying said seat, bearing means rotatably and slidably mounting said foot elements on said seat, said bearing means enabling each of said foot elements to move between a floor-engaging position and a floor-disengaged position, each of said foot elements upon moving from said floor-engaging position to said floor-disengaged position providing for vertical downward movement of the foot element relative to the seat and rotative movement of the foot element in a rearward direction relative to the seat, each of said foot elements upon moving from said floor-disengaged positions to said floor-engaged position providing for vertical downward movement of the seat relative to the foot element and rotative movement of the foot element in a forward direction relative to the seat such that said seat is thereby advanced in a forward direction over the floor during said rotative movement of said foot element in said forward direction, said foot element being operable to move by gravity from said floor-engaging position to said floor-disengaged position when said seat is inclined to one side relative to said floor.

25. A mobile apparatus for use by a person comprising a seat for accommodating said person, a plurality of foot elements underlying said seat, bearing means rotatably and slidably mounting said foot elements on said seat, said bearing means enabling each of said foot elements to move between a floor-engaging position and a floor-disengaged position, each of said foot elements upon moving from said floor-engaging position to said floor-disengaged position providing for vertical downward movement of the foot element relative to the seat and rotative movement of the foot element in a rearward direction relative to the seat, each of said foot elements upon moving from said floor-disengaged positions to said floor-engaged position providing for vertical downward movement of the seat relative to the foot element and rotative movement of the foot element in a forward direction relative to the seat such that said seat is thereby advanced in a forward direction over the floor during said rotative movement of said foot element in said forward direction, said bearing means comprising a bearing mounting on said seat, said bearing mounting including a bearing recess having an upper part and a lower part, said foot element having an upper end portion received in said recess, said upper end portion of said foot element being disposed in said upper part of said bearing recess when said foot element is in said floor-engaging position, said upper end portion of said foot element being disposed in said lower part of said bearing recess when said foot element is in said floor-disengaged position, said bearing mounting on said seat including a protrusion extending into said recess, said bearing mounting including a resilient depending part from which said protrusion extends such that said resilient depending part and said protrusion form a resilient hook.

26. A mobile apparatus for use by a person comprising a seat for accommodating said person, a plurality of foot elements underlying said seat, bearing means rotatably and slidably mounting said foot elements on said seat, said bearing means enabling each of said foot elements to move between a floor-engaging position and a floor-disengaged position, each of said foot elements upon moving from said floor-engaging position to said floor-disengaged position providing for vertical downward movement of the foot element relative to the seat and rotative movement of the foot element in a rearward direction relative to the seat, each of said foot elements upon moving from said floor-disengaged positions to said floor-engaged position providing for vertical downward movement of the seat relative to the foot element and rotative movement of the foot element in a forward direction relative to the seat such that said seat is thereby advanced in a forward direction over the floor during said rotative movement of said foot element in said forward direction, said bearing means comprising a bearing mounting on said seat, said bearing mounting including a bearing recess having an upper part and a lower part, said foot element having an upper end portion received in said recess, said upper end portion of said foot element being disposed in said upper part of said bearing recess when said foot element is in said floor-engaging position, said upper end portion of said foot element being disposed in said lower part of said bearing recess when said foot element is in said floor-disengaged position, said bearing mounting being disposed on the underside of the seat and includes a depending portion which forms a boundary of said bearing recess.

27. A mobile apparatus for use by a person comprising a seat for accommodating said person, a plurality of foot elements underlying said seat, bearing means rotatably and slidably mounting said foot elements on said seat, said bearing means comprising a plurality of spaced mounting elements depending downwardly from said seat, said bearing means enabling each of said foot elements to move between a floor-engaging position and a floor-disengaged position, each of said foot elements upon moving from said floor-engaging position to said floor-disengaged position providing for vertical downward movement of the foot element relative to the seat and rotative movement of the foot element in a rearward direction relative to the seat, each of said foot elements upon moving from said floor-disengaged positions to said floor-engaged position providing for vertical downward movement of the seat relative to the foot element and rotative movement of the foot element in a forward direction relative to the seat such that said seat is thereby advanced in a forward direction over the floor during said rotative movement of said foot element in said forward direction.

28. A mobile apparatus for use by a person comprising a seat for accommodating said person, a plurality of foot elements underlying said seat, bearing means rotatably and slidably mounting said foot elements on said seat, said bearing means being operable to enable attachment and detachment of the foot elements to and from the seat, said bearing means enabling each of said foot elements to move between a floor-engaging position and a floor-disengaged position, each of said foot elements upon moving from said floor-engaging position to said floor-disengaged position providing for vertical downward movement of the foot element relative to the seat and rotative movement of the foot element in rearward direction relative to the seat, each of said foot elements upon moving from said floor-disengaged positions to said floor-engaged position providing for vertical downward movement of the seat relative to the foot element and rotative movement of the foot element in a forward direction relative to the seat such that said seat is thereby advanced in a forward direction over the floor during said rotative movement of said foot element in said forward direction.

29. A mobile apparatus for use by a person comprising a seat for accommodating said person, a plurality of foot elements underlying said seat, bearing means rotatably and slidably mounting said foot elements on said seat, said bearing means enabling each of said foot elements to move between a floor-engaging position and a floor-disengaged position, each of said foot elements upon moving from said floor-engaging position to said floor-disengaged position providing for vertical downward movement of the foot element relative to the seat and rotative movement of the foot element in a rearward direction relative to the seat, each of said foot elements upon moving from said floor-disengaged positions to said floor-engaged position providing for vertical downward movement of the seat relative to the foot element and rotative movement of the foot element in a forward direction relative to the seat such that said seat is thereby advanced in a forward direction over the floor during said rotative movement of said foot element in said forward direction, and a stabilizer element which is in constant contact with the floor.

* * * * *